US006139276A

United States Patent [19]

Blateri et al.

[11] Patent Number: 6,139,276

[45] Date of Patent: Oct. 31, 2000

[54] CEILING FAN ASSEMBLY AND METHOD FOR ASSEMBLING SAME

[75] Inventors: Frank Blateri, Coppell, Tex.; Wang Liang Chou, Taichung, Taiwan

[73] Assignee: Aloha Housewares Co., Ltd., Taichung Hsiang, Taiwan

[21] Appl. No.: 09/196,798

[22] Filed: Nov. 20, 1998

[51] Int. Cl.[7] ..... B63H 1/20

[52] U.S. Cl. ..... 416/210 R; 416/220 A

[58] Field of Search ..... 416/5, 206, 207, 416/210 R, 219 A, 220 A, 221, 204 R; 403/331, 327, 326, 315, 319

[56] References Cited

U.S. PATENT DOCUMENTS

| | | | |
|---|---|---|---|
| 4,019,298 | 4/1977 | Johnson, IV | 403/331 |
| 4,396,352 | 8/1983 | Pearce . | |
| 4,511,310 | 4/1985 | Pearce . | |
| 4,565,494 | 1/1986 | Dinger . | |
| 4,746,271 | 5/1988 | Wright . | |
| 4,850,799 | 7/1989 | Bucher, Sr. et al. . | |
| 4,936,751 | 6/1990 | Marshall . | |
| 5,180,284 | 1/1993 | Monrose, III et al. . | |
| 5,304,037 | 4/1994 | Scofield . | |
| 5,458,463 | 10/1995 | Chiang . | |
| 5,458,464 | 10/1995 | Lee . | |
| 5,486,094 | 1/1996 | Davis, Jr. . | |
| 5,542,819 | 8/1996 | Bucher et al. . | |
| 5,628,095 | 5/1997 | Appel et al. | 403/315 |
| 5,722,814 | 3/1998 | Yu . | |
| 5,873,701 | 2/1999 | Shiu . | |
| 5,951,197 | 9/1999 | Wu | 416/206 |

FOREIGN PATENT DOCUMENTS

| | | |
|---|---|---|
| 3021280 A1 | 12/1981 | Germany . |
| 60-56198 | 4/1985 | Japan . |

*Primary Examiner*—Edward K. Look
*Assistant Examiner*—Hermes Rodriguez
*Attorney, Agent, or Firm*—Haynes and Boone, LLP

[57] ABSTRACT

A fan assembly according to which a block member is connected to a rotor end casing and an arm member having a blade connected thereto is mounted to the block member. One of the members has a radially extending slot formed therein and the other member has a mounting flange adapted to extend into the slot when the arm is moved radially outwardly relative to the block member to mount the arm to the block member without the need for additional components.

33 Claims, 3 Drawing Sheets

CEILING FAN ASSEMBLY AND METHOD FOR ASSEMBLING SAME

BACKGROUND OF THE INVENTION

The present invention relates to a ceiling fan assembly and a method for assembling same, and, more particularly, to such an assembly and method in which the assembly can be assembled relatively easily and quickly using a minimum number of parts.

Rotating fans that are mounted to the ceilings of homes and businesses are very popular. These types of fans consist of a plurality of angularly-spaced blades and a plurality of arms that connect the blades to the rotor portion of an electric motor mounted in a housing, which, in turn, extends from a ceiling. Since the blades, arms and the motor are often manufactured and shipped separately, they must be assembled and mounted at the site. However, this assembly and mounting is relatively difficult and time-consuming since each blade must be attached to its arm by a plurality of fasteners, and each arm is attached to the rotor end casing by a plurality of fasteners. Since there are usually five blades and arms, the labor costs involved in assembling and mounting the complete fan assembly constitutes a very high percentage of the overall cost of the assembly. This difficultly in assembly is compounded by the fact that the rotor end casing of the fan motor is initially mounted to the ceiling the above-mentioned arms and blades often have to be mounted to the end casing in its elevated position.

Therefore, what is needed is a fan assembly and a method of assembling same in which the fan blades can be easily and quickly attached to the arms, and the arms can be easily and quickly attached to the motor even when mounted to the ceiling, thus considerably reducing the labor costs in assembling and mounting the fan assembly.

SUMMARY OF THE INVENTION

An embodiment of the present invention, accordingly, is directed to a ceiling fan assembly and method for assembling same according to which a block member is connected to a rotor end casing and an arm member having a blade connected thereto is mounted to the block member. One of the members has a radially extending slot formed therein and the other member has a mounting flange adapted to extend into the slot when the arm is moved radially outwardly relative to the block member to mount the arm to the block member without the need for additional components.

Several advantages result from this arrangement. For example, the use of a plurality of nuts, bolts and screws is eliminated and the blades can be connected to the arms, and the arms to the rotor, using a minimum of fasteners. Also, the centrifugal forces causes by normal rotation of the fan tend to force the flange radially outwardly relative to the slot and thus secure the connection of the arm to the mounting block. Also, the fan assembly can be assembled and mounted relatively easily and quickly thus considerably reducing the labor costs.

DESCRIPTION OF THE PREFERRED EMBODIMENT

Figure 1:
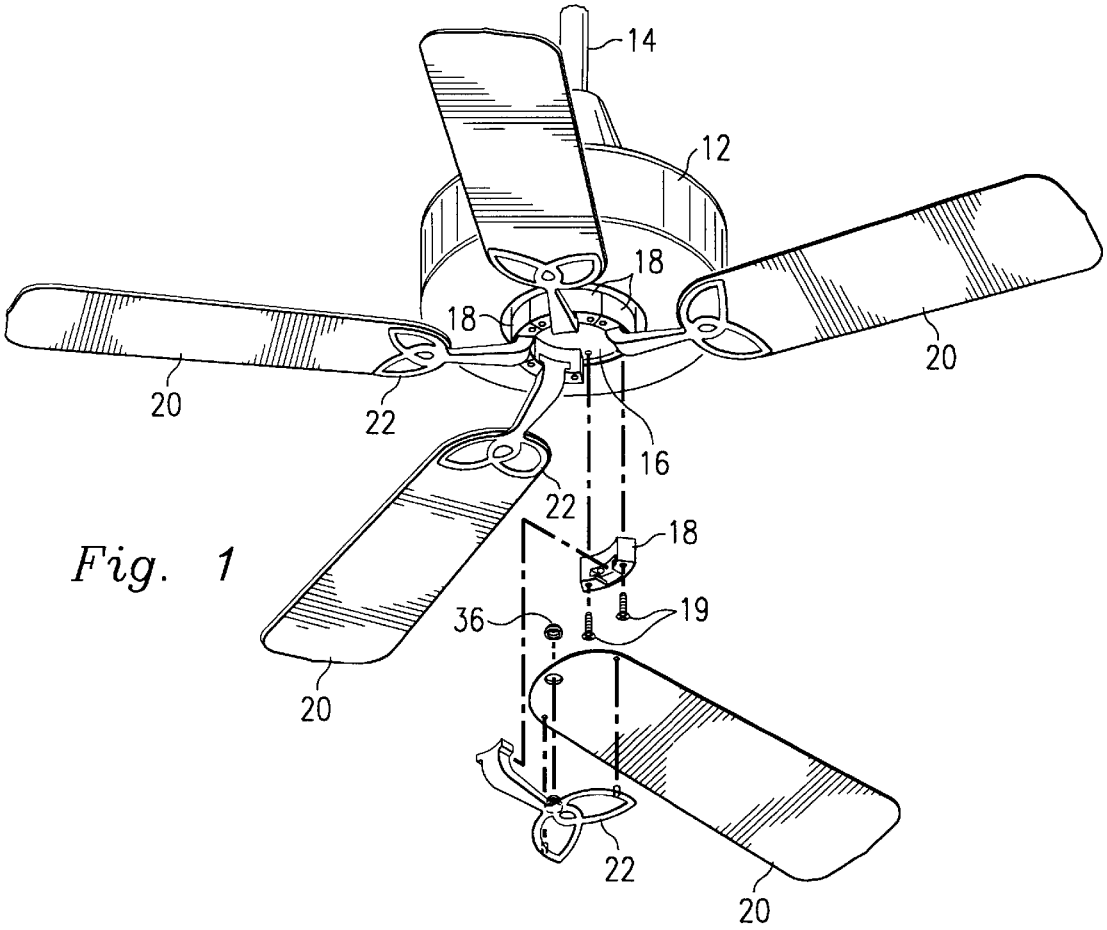
FIG. 1 is an isometric, partially exploded, view of the fan assembly of an embodiment of the present invention.

FIG. 1 of the drawings depicts the fan assembly of an embodiment of the present invention which assembly is referred to, in general, by the reference numeral 10 and which includes a housing 12 connected to a ceiling of a building by a mounting rod 14. It is understood that the mounting rod 14 is connected to the ceiling in any known manner, and that electrical conductors extend from an electrical box (not shown) mounted to the ceiling, through the rod, and into the interior of the housing 12. A conventional electrical motor is provided in the housing 12 that includes a stator (not shown) and a rotor that includes an end casing 16 that protrudes slightly through an opening in the surface of the housing.

Five arcuate mounting blocks 18 are mounted to the end casing 16 by a plurality of screws 19 extending through aligned openings in the mounting blocks and the casing. The mounting blocks 18 are mounted with the corresponding ends of each adjacent pair in close proximately so that the assembled blocks together form an annulus extending downwardly from the end casing 16.

Figure 3:
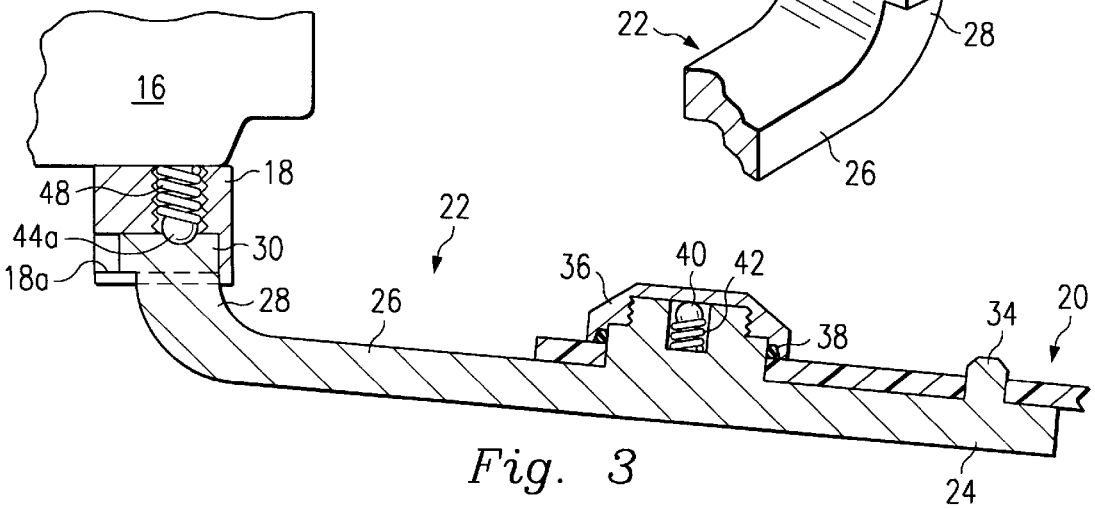
FIG. 3 is a sectional view of a portion of the fan assembly of FIGS. 1 and 2.
Figure 2:
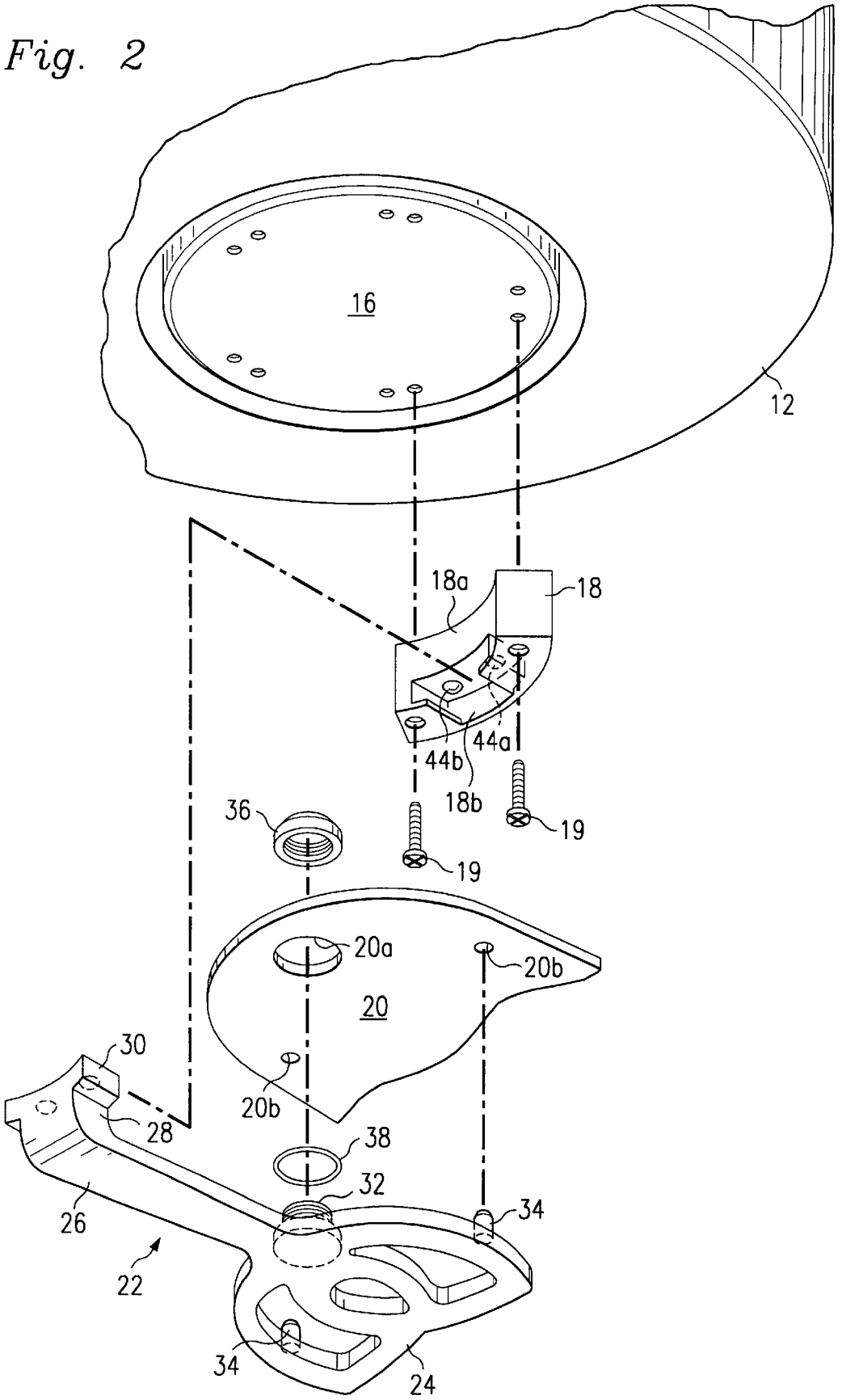
FIG. 2 is an enlarged, isometric, exploded view depicting one blade and its associated components of the fan assembly of FIG. 1.

Five elongated blades 20 are respectively mounted to the end portions of five mounting arms 22, and the details involving the connection of a blade 20 to its corresponding arm 22 are better shown in FIGS. 2 and 3. More particularly, each arm 22 includes a relatively wide mounting portion 24 that has openings extending therethrough to reduce its weight, and a necked-down portion 26 one end of which extends from the portion 24. The other end portion of the necked-down portion 26 is bent to form a portion 28 which extends substantially vertically as viewed in the drawing, and a mounting flange 30 is formed at the end of the portion 28.

A externally threaded post 32 and two guide pins 34 all extend from the upper surface of the arm portion 26. Preferably, arm portions 24, 26, 28, and 30, as well as the post 32 and the guide pins 34 are all molded integrally.

The corresponding end of each blade 20 has an enlarged opening 20*a* (FIG. 2) extending therethrough for receiving its corresponding post 32, and two other openings 20*b* for receiving the corresponding two guide pins 34, respectively. An internally threaded cap 36 threadedly engages the post 32 to retain the blade 20 to the arm 22, and a seal ring 38 extends between the lower outer surface of the post 32 and the inner wall of the cap 36. A counter bore is provided in the post 32 which receives a ball 40, and a spring 42 extends between the ball and the bottom of the counter bore to urge the ball upwardly, as viewed in FIG. 3, and tighten the threaded connection between the cap 36 and the post 32.

As better shown in FIG. 2, each block 18 has a curved inner surface 18*a* and an opposite curved outer surface (FIG. 1). A slot 18*b* is formed in each block 18 and extends from the inner surface 18*a* of the block into, but not completely through, the block. The slot 18*b* is sized so as to receive the flange 30 of the arm 22 in a relatively tight fit. To this end, and as better shown in FIG. 4, the side walls of the flange 30 are tapered inwardly.

Figure 4:
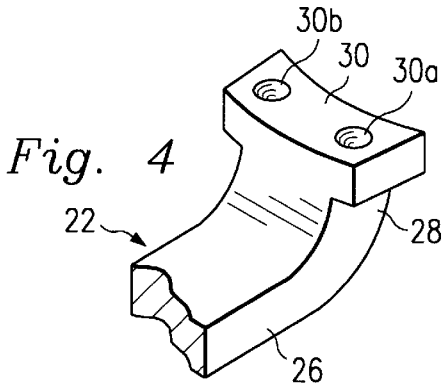
FIG. 4 is an enlarged isometric, partial view of a component of the fan assembly of FIGS. 1–3.

As also shown in FIG. 4, a pair of spaced recesses 30*a* and 30*b* are formed in the upper surface of the flange 30 and, as shown in FIG. 2, a pair of spring loaded balls 44*a* and 44*b* are provided in the mounting block 18 for extending in the recesses. The ball 44*a* is shown in detail in FIG. 3, and is mounted in a bore formed in an externally threaded shaft 46 which extends through an opening in the block 18. A spring 48 is disposed in the shaft 46 for urging the ball 44*a* downwardly as shown so that a lower portion of the ball projects slightly from the end of the shaft and into the slot 18*b*. The other ball 44*b* is mounted in the block in the same manner, and the balls 44*a* and 44*b* are spaced so as to align with, and extend in, the recesses 30*a* and 30*b*, respectively, when the flange 30 is inserted in the slot 18*b*, to retain the flange in the slot.

To mount the ceiling fan 10 to a ceiling, the rod 14 (FIG. 1) is connected to the ceiling in any known manner, and the housing 12 is connected to the rod with the lower portion of the rotor end casing 16 protruding slightly from the lower end of the housing 12 as shown in FIG. 2. The blocks 18 are attached to the end casing 16 by the screws 19, and each blade 20 is attached to the arm 22 in the manner described above. The flange 30 of each arm 22 is then inserted in its corresponding block 18 by positioning the flange radially inwardly from, and aligned with, the slot 18*b* and moving the flange radially outwardly until the flange is secure in the slot. In this position, the balls 44*a* and 44*b* in the block are urged into the recesses 30*a* and 30*b* of the corresponding flange 30 in the manner describe above to lock the flange 30 in the slot 18*b*. In this manner, rotation of the fan creates centrifugal forces that urge each flange 30 in a radial outwardly direction to further secure the flanges in their respective slots 18*b* in the blocks 18.

Although only one blade 20, arm 22 and mounting block 18 are shown in FIGS. 2 and 3, it is understood that the other blades, arms and mounting blocks are identical and are connected together and mounted to the end casing 16 in the same manner.

As a result of the foregoing, the use of a large number of nuts, bolts and screws is eliminated and the blades can be connected to the arms, and the arms to the rotor, using a minimum of fasteners. Also, the arms are connected to end casing by simply inserting them in the slotted mounting blocks without the need for a retaining ring, or the like. Also, the centrifugal forces causes by normal rotation of the fan tend to force the flanges radially outwardly in their corresponding slots and thus secure the connection of the arm to the mounting block. Also, the fan assembly can be assembled and mounted relatively easily and quickly thus considerably reducing the labor costs.

Figure 5:
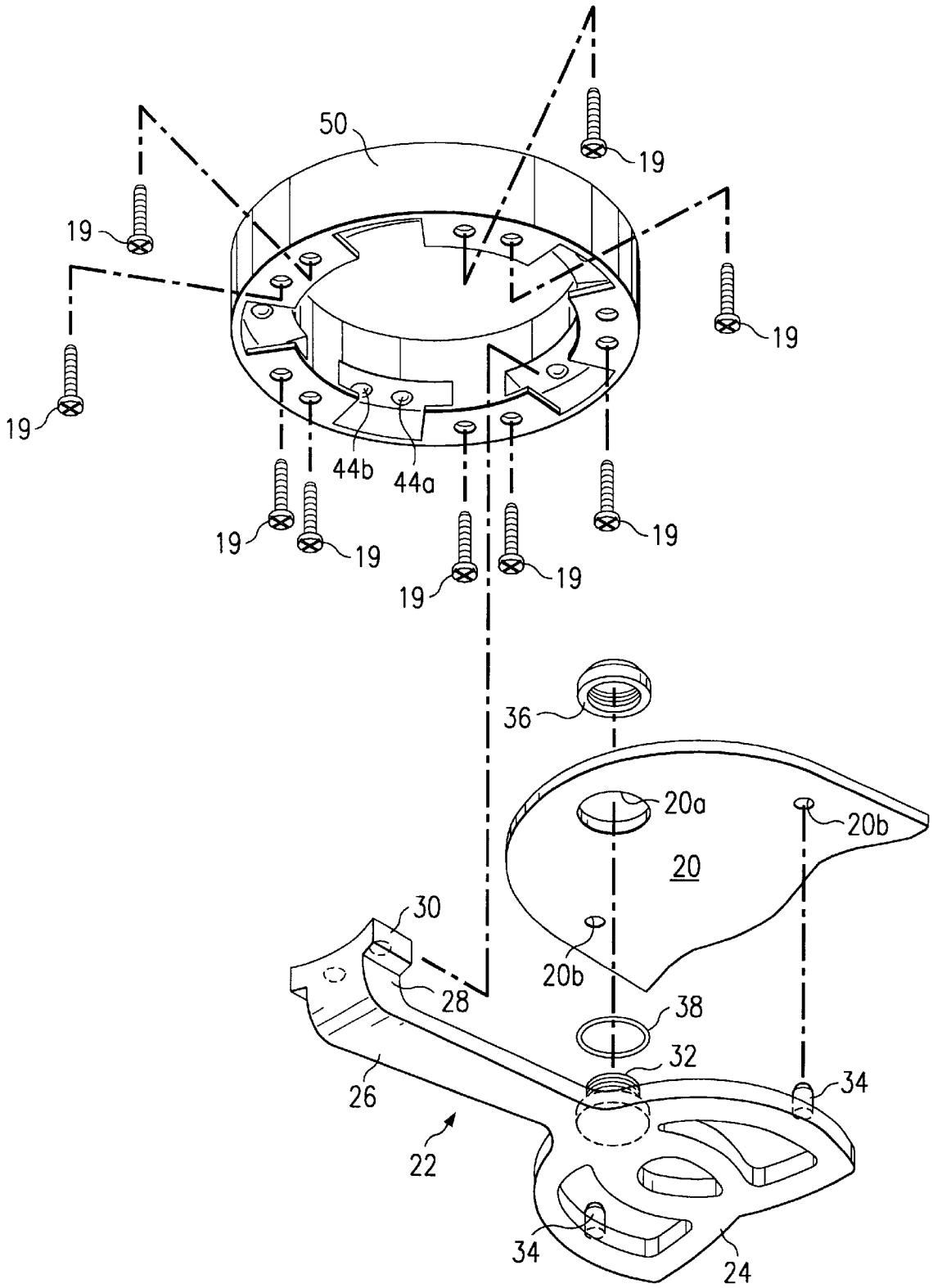
FIG. 5 is an isometric, exploded view, depicting an alternate embodiment of the present invention.

FIG. 5 depicts an alternate embodiment of the present invention which includes many identical components of the previous embodiment which are given the same reference numerals. According to the embodiment of FIG. 5, a continuous, annular, ring-like mounting member 50 is provided in place of the plurality of mounting blocks 18 of the previous embodiment. A plurality of angularly-spaced slots 50*b* are formed in the member which are identical to the slots 18*b* of the previous embodiment and which function to receive the flange 30 of the arm 22 in the manner described above in connection with the previous embodiment. Otherwise, all of the components of the embodiment of FIG. 5 are identical to those of the previous embodiment including the screws 19 that bolt the member 50 to the end casing 16, and the balls 44*a* and 44*b* which extend in the recess is the member 50 and function in the same manner as the previous embodiment.

Thus the embodiment of FIG. 5 enjoys all of the advantages of the previous embodiment.

It is understood that variations may be made in the foregoing without departing from the scope of the invention. For example, the number of blades 20 used in each embodiment can vary within the scope of the invention. Also, the post 22*d* and the guide pins 22*e* of each arm 22 can be fabricated separately and press fitted, or attached in any other known manner, to the arm. Moreover, the latter annulus, or ring-like member may be formed integrally with the end casing 16 thus eliminating the need to fasten the individual blocks or annulus to the end casing with the fasteners 19.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fan assembly comprising a rotor casing; an annular block member extending from the casing and having at least one slot formed in one surface thereof and extending from the surface in a radial outwardly direction relative to the casing; a plurality of arms each having a flange member formed at one end thereof and adapted to be inserted into the at least one slot and moved radially outwardly relative to the casing to mount the arms to the block member without the need for additional components; and a blade connected to each arm.

2. The assembly of claim 1 wherein the block member has a curved inner surface and a curved outer surface relative to the casing, the slot being provided in the inner surface.

3. The assembly of claim 1 wherein the front end of the flange member is initially inserted in the slot and wherein the width of the flange member increases from the front end to the rear end thereof to facilitate insertion of the flange member in the slot and to establish a friction fit of the flange member in the slot.

4. The assembly of claim 1 further comprising at least one protrusion formed on one of the members and at least one recess formed in the other members for receiving the protrusion to retain the flange member in the slot.

5. The assembly of claim 4 wherein the protrusion is a ball, and further comprising a spring urging the ball towards the recess.

6. The assembly of claim 1 wherein the blade has an opening and where a post extends from the arm and through the opening; and further comprising a retainer member for engaging the post to secure the blade to the arm.

7. The assembly of claim 6 wherein the post is externally threaded and wherein the retainer member is an internally threaded cap that threadedly engages the post.

8. The assembly of claim 6 further comprising at least one guide pin on the arm and at least one additional opening in the blade for receiving the guide pin to align the blade relative to the arm.

9. The assembly of claim 1 wherein the block member is formed integrally with the casing.

10. A fan assembly comprising a rotor casing; an annular block member extending from the casing and having at least one slot formed therein; a plurality of arm members each having a mounting flange formed thereon and adapted to extend into the slot to mount the arms to the block member without the need for additional components; and a blade connected to each arm member.

11. The assembly of claim 10 wherein the block member has a curved inner surface and a curved outer surface, the slot being provided in the inner surface.

12. The assembly of claim 11 wherein the width of the flange increases from the front end to the rear end thereof to facilitate insertion of the flange in the slot and to establish a friction fit of the flange in the slot.

13. The assembly of claim 10 further comprising a plurality of protrusions formed on the block member and at least one recess formed in each arm member for receiving the protrusions to retain the flanges in the slot.

14. The assembly of claim 13 wherein the protrusion is a ball, and further comprising a spring urging the ball towards the recess.

15. The assembly of claim 10 wherein the blade has an opening and where a post extends from the arm and through the opening; the latter fastener being in the form of a retainer member for engaging the post to secure the blade to the arm.

16. The assembly of claim 15 wherein the post is externally threaded and wherein the retainer member is an internally threaded cap that threadedly engages the post.

17. The assembly of claim 10 further comprising at least one guide pin on the arm member and at least one additional opening in the blade for receiving the guide pin to align the blade relative to the arm.

18. The assembly of claim 10 further comprising a plurality of blades respectively connected to the arm members.

19. The assembly of claim 10 wherein the block member is formed integrally with the casing.

20. The assembly of claim 10 further comprising a protrusion formed on each arm member and at least one recess formed in block member for receiving the protrusions to retain the flanges in the slot.

21. The assembly of claim 20 wherein the protrusion is a ball, and further comprising a spring urging the ball towards the recess.

22. A fan assembly comprising a rotor casing, an arcuate block member extending from the casing in a spaced relation to the axis of the casing, the block member having a first surface facing in a direction towards the axis of the casing and a second surface radially spaced from the first surface in a radial direction, a slot formed in the first surface and extending to an area in the interior of the block member between the first surface and the second surface to form an end wall, and an arm having a flange member formed at one end thereof and adapted to be inserted in the slot and moved towards the second surface until it engages the end wall to mount the arm to the block member.

23. The assembly of claim 22 further comprising a blade connected to the arm.

24. The assembly of claim 23 wherein the mounting block is arcuate in shape and wherein the first and second surfaces are curved.

25. The assembly of claim 22 wherein the front end of the flange member is initially inserted in the slot and wherein the width of the flange member increases from the front end to the rear end thereof to facilitate insertion of the flange member in the slot and to establish a friction fit of the flange member in the slot.

26. The assembly of claim 22 further comprising at least one protrusion formed on one of the members and at least one recess formed in the other members for receiving the protrusion to retain the flange member in the slot.

27. The assembly of claim 26 wherein the protrusion is a ball, and further comprising a spring urging the ball towards the recess.

28. The assembly of claim 26 wherein the blade has an opening and further comprising a post extending from a surface of the arm and through the opening; and a retainer member for engaging the post to secure the blade to the arm.

29. The assembly of claim 28 wherein the post is externally threaded and wherein the retainer member is an internally threaded cap that threadedly engages the post.

30. The assembly of claim 22 further comprising at least one guide pin extending from the surface of the arm, and at least one additional opening in the blade for receiving the guide pin to align the blade relative to the arm.

31. The assembly of claim 22 wherein there are a plurality of block members and a plurality of arms respectively connected to the block members, and further comprising a plurality of blades respectively connected to the arms.

32. The assembly of claim 22 wherein the block member is in the form of an annulus and wherein a plurality of arms are connected to the block member, and further comprising a plurality of blades respectively connected to the arms.

33. The assembly of claim 22 wherein the block member is formed integrally with the casing.

* * * * *